United States Patent [19]

Forester

[11] Patent Number: 4,512,410

[45] Date of Patent: Apr. 23, 1985

[54] GEOTHERMAL EXPANSION WELLHEAD SYSTEM

[76] Inventor: Buford G. Forester, 2128 Hazlitt, Houston, Tex. 77032

[21] Appl. No.: 532,800

[22] Filed: Sep. 16, 1983

[51] Int. Cl.[3] ..... E21B 33/03; E21B 33/126; F16L 7/00; F16L 27/12

[52] U.S. Cl. ..... 166/380; 166/84; 166/88; 166/173; 166/387; 277/59; 277/72 FM; 285/187; 285/106; 285/302

[58] Field of Search ..... 166/380, 387, 86, 88, 166/90, 84, 82, 187, 303, 170, 173; 285/302, 187, 106, 162; 277/72 FM, 59

[56] References Cited

U.S. PATENT DOCUMENTS

| | | | |
|---|---|---|---|
| 2,319,543 | 5/1943 | Hall | 277/72 FM |
| 2,323,179 | 6/1943 | Hall et al. | 285/302 X |
| 3,291,490 | 12/1966 | Balmer | 277/72 FM X |
| 3,976,130 | 8/1976 | Chambless et al. | 166/84 |
| 4,050,517 | 9/1977 | Matthews | 166/106 X |
| 4,299,395 | 11/1981 | Reed | 166/77.5 X |
| 4,390,063 | 6/1983 | Wells, Jr. | 166/88 X |

*Primary Examiner*—Stephen J. Novosad

[57] ABSTRACT

A geothermal expansion wellhead system is provided which adapts the wellhead and control valves to the casing in the wellbore. The system suspends and seals the casing while expanding and contracting during geothermal operations at temperatures up to 550° F. and above. The system consists of an expansion spool in which there is mounted an expansion mandrel which is secured on the end of the production casing extending out of a cemented geothermal well. The expansion mandrel has a hard smooth surface, preferably produced by electroplating. Annular seals seal the annulus between the expansion mandrel and the expansion spool and have a sliding engagement with the hard smooth surface of the expansion mandrel. The annular seals are energized by pressurization with a high temperature plastic composition and the seal may be re-energized at any time during operation. The expansion mandrel includes scraper elements which scrape off corrosion or other deposits on the inner surface of the expansion spool. Various modifications of the system well operate on high temperature, superheated hot water; wet steam; and dry steam.

27 Claims, 5 Drawing Figures

GEOTHERMAL EXPANSION WELLHEAD SYSTEM

BACKGROUND OF THE INVENTION

1. Field of the Invention

This invention relates to new and useful improvements in geothermal wells and more particularly to geothermal expansion wellhead systems for completing geothermal wells and providing for expansion and contraction of the production casing due to thermal cycling.

2. Description of the Prior Art

In recent years, the drilling of wells for production of geothermal energy has become commercially important. In the drilling of geothermal wells, a well bore is drilled into a formation located at a sufficient depth in the earth to be at a very high temperature and having a source of water flowing into the formation. As a result, such a formation has superheated hot water and or high temperature steam available to be reduced to the surface through the geothermal well. Geothermal wells are a source of substantially renewable energy in that they tap the natural heat of the earth's core.

The drilling and completion of geothermal wells is substantially different from the drilling and completion of oil, gas and water wells. This primarily due to the fact that the drilling extends into very high temperature formations where special drilling equipment may be required. Problems are additionally encountered in the completion of geothermal wells in that the well casing which extends from the high temperature area to conduct high temperature pressurized hot water and/or steam to the surface is subject to expansion and contraction due to thermal cycling. The expansion and contraction of the well casing due to thermal cycling may result in a very substantial movement of the upper end of the production casing in response to temperature changes.

In the past, geothermal wells have been completed by use of ordinary wellheads which may move up and down with the expansion and contraction of the production casing. This necessitated the use of flexible connections to conduct the high temperature hot water and or steam to the point of utilization. The movement of the wellhead with expansion and contraction of the production casing has presented numerous problems in the production of energy from geothermal wells.

Another approach to the completion of geothermal wells, has been the use of expansion joints in the wellhead assembly. One commercially available geothermal wellhead system (no published literature or patents are known which describe this system) has an expansion joint which includes an expansion spool in which the production casing is allowed to expand or contract. An annular seal is positioned between the production spool and the exterior surface of the production casing to seal off the pressure from below. The production casing can become corroded or roughened with deposits of material during production of steam and hot water from the well and the deposits on the casing may result in undue wear of the pressure seal in the expansion spool.

There has been a substantial need for a well designed geothermal wellhead expansion system in which the seals are easily serviced and the sealing does not take place against a rough surface such as that encountered on production casing.

SUMMARY OF THE INVENTION

One object of this invention is to provide a new and improved system or apparatus for completion of a geothermal well and production of geothermal energy therefrom.

Another object is to provide for an improved geothermal wellhead system which adapts the wellhead and control valves to the casing in the well bore.

Another object is to provide an improved geothermal wellhead system which suspends and seals the production casing while expanding and contracting during geothermal operations at high temperatures.

Still another object of the invention is to provide an improved geothermal expansion wellhead system having seals which may be re-energized during operation of the well.

Still another object of the invention is to provide an improved geothermal expansion wellhead system including an expansion spool and an expansion mandrel reciprocally movable in the spool and connected to the production casing, with an improved annular seal surrounding the mandrel and sealing against the smooth surface of the mandrel.

Other objects of the invention well come apparent from time to time throughout the specification and claims as hereinafter related.

The foregoing objects, and other objects of the invention are accomplished by a geothermal expansion wellhead system which adapts the wellhead and control valves to the casing in the wellbore. The system suspends and seals the casing while expanding and contracting during geothermal operations at temperatures of 550 and above. The system consist of an expansion spool in which there is mounted an expansion mandrel which is secured on the end of the production casing extending out of a cemented geothermal well. The expansion mandrel is a hard smooth surface, preferably produced by electroplating. Annular seals seal annulus between the expansion mandrel and the expansion spool and have a sliding engagement with the hard smooth surface of the expansion mandrel. The annular seals are energized by pressurization with a high temperature plastic composition and the seal may be re-energized from time to time when ever the joint is taken down for service. The expansion mandrel includes scraper elements which scrape off corrosion or other deposits on the inner surface of the expansion spool. Various modifications of the system well operate on high temperature, superheated hot water, wet steam, and dry steam.

DESCRIPTION OF A PREFERRED EMBODIMENT

Figure 1:
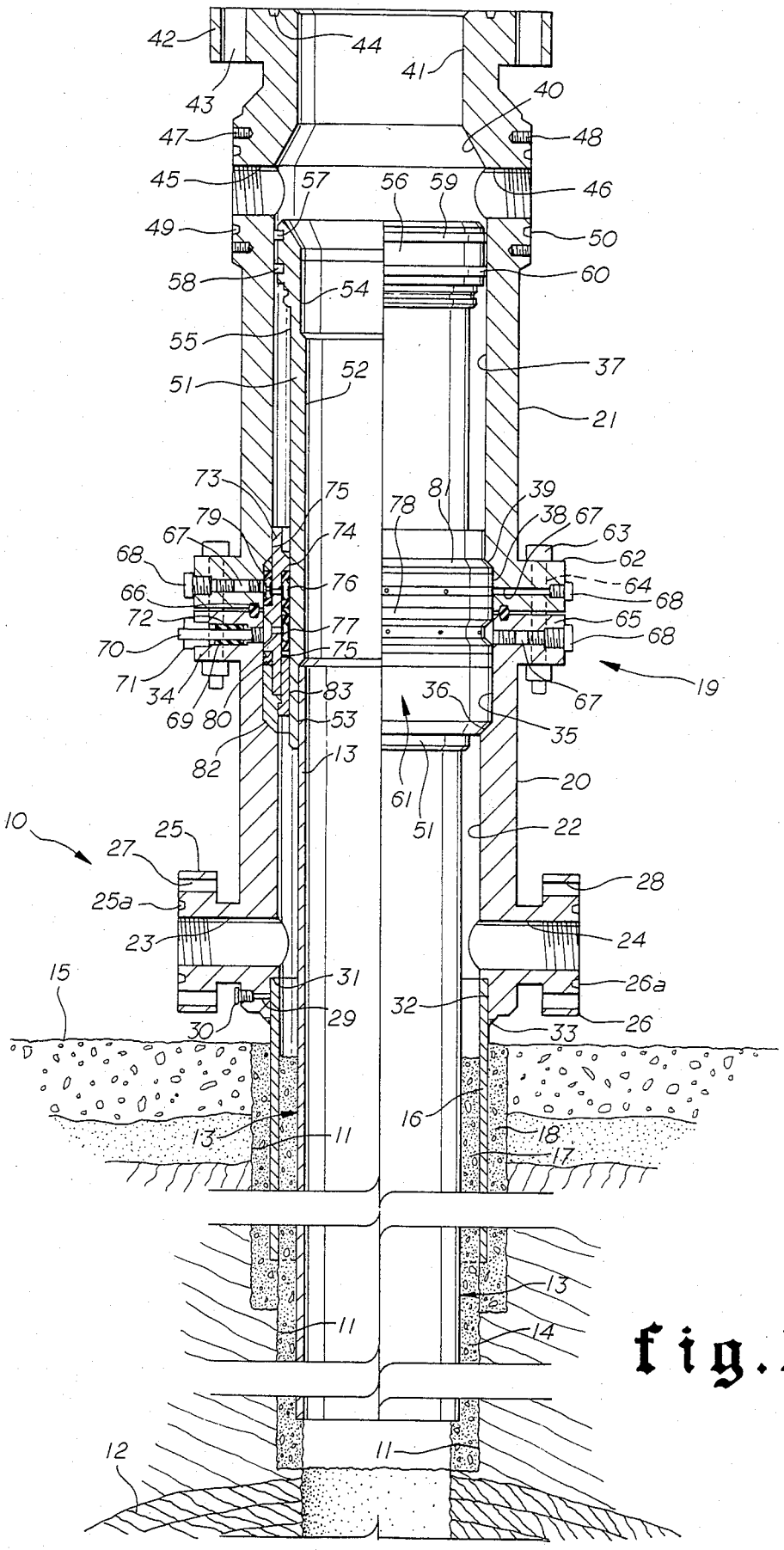
FIG. 1 is a view in vertical cross section of one preferred embodiment of a geothermal expansion wellhead system showing the expansion joint and its connection to production casing extending to the geothermal production zone.
Figure 4:
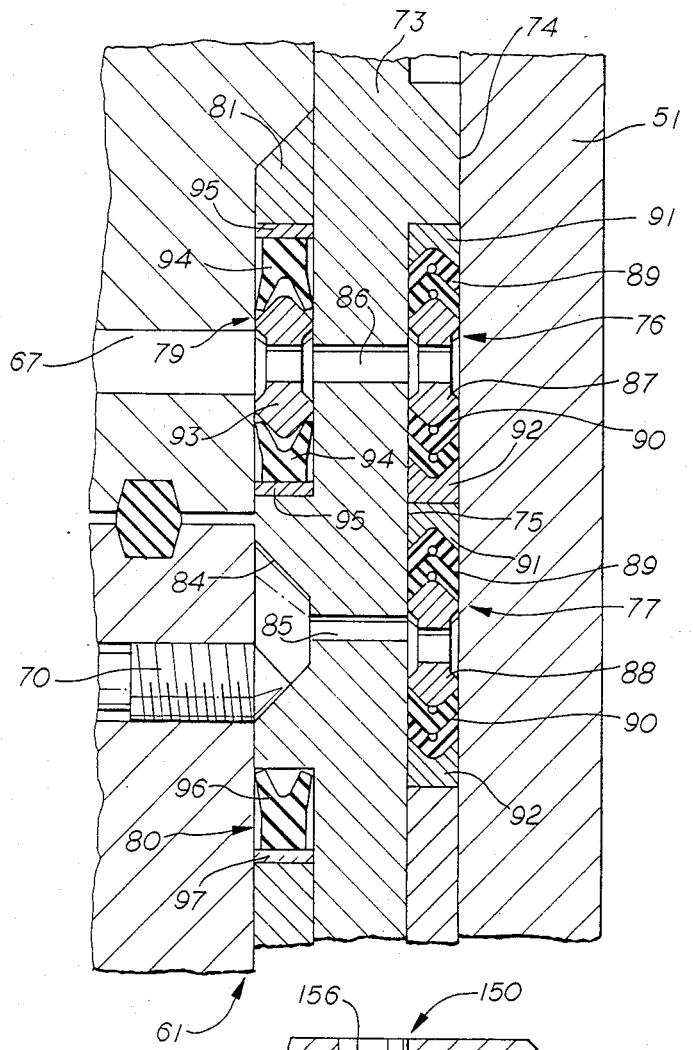
FIG. 4 is a detail, somewhat enlarged, sectional view of the dual annulus seal assembly of the geothermal expansion system shown in FIG. 1.

Referring to the drawings by numeral of reference, and more particularly to FIGS. 1 and 4, there is shown a geothermal well 10 which comprises a well bore 11 extending through various formations into a geothermal producing zone 12. Well bore 11 has a production casing 13 which is surrounded by cement 14 extending from geothermal production zone 12 to a point relatively near the surface 15 of the earth.

The upper portion of bore 11 is slightly enlarged to receive a surface casing 16 which extends from the upper formations through the surface 15 of the earth to a point above the surface where the geothermal expansion apparatus is assembled. Production casing 13 extends through surface casing 16 and is sufficiently smaller than the surface casing to provide a small annular passage or space which is filled with production cement 17 which extends as a continuation of cement layer 14 substantially to the surface 15 of the earth. The enlarged bore portion 11 surrounding surface casing 16 is filled with surface cement layer 18 which extends from the bottom of the enlarged bore hole portion 11 to the surface 15 of the earth. Cement layer 14 surrounding the lower end of production casing 13 secures the casing in the well bore. The surface cement layer 18 secures surface casing 16 in the enlarged portion of the well bore, while cement layer 17 secures production casing 13 in a spaced relation to the surface casing 16.

A thermal expansion apparatus 19 is secured on the upper end of surface casing 16 with production casing 13 extending into the apparatus. Thermal expansion apparatus 19 comprises a lower tubular spool or casing head 20 and an upper expansion receiver spool 21. Lower tubular spool or casing head 20 has an internal bore 22 intersected by side openings 23 and 24 having connecting flanges 25 and 26 respectively. Flanges 25 and 26 are provided with holes 27 and 28 for bolting to flanged covers or pipe connectors for introduction of cement during the cementing of the casing in place. Grooves 25*a* and 26*a* are provided in flanges 25 and 26 to receive sealing gasket rings (not shown) for sealing the flanged connections when made up. A bleed opening 29 is closed by a threaded plug 30.

The upper end of surface casing 16 abuts against a shoulder 31 provided by a counterbore 32 in the lower tubular spool or casing head 20. Surface casing 16 is secured to the lower tubular spool or casing head 20 by welding as indicated at 33. The upper end of lower tubular spool or casing head 20 is provided with a peripheral flange 34 which has several opening, to be described more fully below. The upper end of tubular spool or casing head 20 has a counterbore 35 with a beveled surface 36 making the transition to the bore 22.

Expansion receiver spool 21 has an internal bore 37 with a counterbore 38 and interconnecting bevel 39 at the lower end. Bore 37 has a beveled portion 40 leading to a reduced bore 41 at the outlet end of the expansion device. The outlet end of the expansion device has a flange 42 with holes 43 provided for connection to the flange on a control valve (not shown). A face groove 44 is provided for receiving a gasket for sealing against a like groove in the flange of the control valve. A pair of side openings 45 and 46 open laterally from the bore 37 of expansion receiver spool 21. Spool 21 has threaded recesses 47 and 48 surrounding openings 45 and 46 for securing a flanged connector thereto. Peripheral grooves 49 and 50 are provided for receiving gasket to fit against like groove in the flange to be connected thereto.

A casing expansion mandrel 51 is positioned for sliding movement in expansion receiver spool 21. Expansion mandrel 21 is tubular in shape with an internal bore 52 having a counterbore 53 at the lower end and a beveled counterbore at the upper end. The lower counterbore 53 of expansion mandrel 51 has an interference fit with the upper end of production casing 13 and is movable in response to thermal expansion and contraction of the production casing. Expansion mandrel 51 has a smooth cylindrical exterior surface 55 which is preferably produced by an extremely hard electrodeposited chromium finish so that the surface well not wear the annulus seals excessively. Expansion mandrel 51 has an enlarged upper end portion 56 with grooves 57 and 58 therein receiving scraper rings 59 and 60. Scraper rings 59 and 60 are sized to have a close sliding compact with the bore 37 of expansion receiver spool 21 to scrape the surface clean of corrosion or other deposits.

Expansion mandrel 51 has a sliding fit in double annulus seal assembly 61 which is secured between beveled surfaces 36 and 39 and spools 20 and 21. Spools 20 and 21 have their flanges 34 and 62 secured together by a plurality of bolts 63 extending through spaced holes 64 and 65. Flanges 34 and 62 have aligned faced grooves which receive a sealing gasket 66. Flanges 34 and 62 are each provided with radially extending passages 67 which are closed by threaded plugs 68. Another passage 69 is provided with a threaded retaining pin 70 which engages the peripheral surface of annulus seal assembly 61. Threaded retainer 70 is mounted in bushing 71 and sealed against pressure loss by packing 72.

Dual annulus seal assembly 61 is enlarged somewhat in the sectional view shown in FIG. 4 for the purposes of showing the structure of the seal components. The description of this assembly will therefore have reference to both FIG. 1 and FIG. 4. The seal assembly 61 comprises a sleeve member 73 having an internal bore 74 with a sliding fit against the external surface 55 of mandrel 51 and an external surface 75 fitting the bore 37 of spool 21. Sleeve member 73 has a counterbore 75 providing an annular space in which sealing elements 76 and 77 are positioned.

Sleeve member 73 has an outer surface 78 which has a close fit with the counterbores 35 and 38 of spools 20 and 21. The outer surface of sleeve member 73, at the opposite ends, is spaced from counterbores 35 and 38 to provide an annular space receiving seals 79 and 80. Seal 79 is secured in place by retaining ring 81 while seal 80 is secured in place by outer and inner sleeves 82 and 83 which fit around the lower end portion of sleeve member 73. Sleeve member 73 has a peripheral groove 84 with a hole or passage 85 extending to the inner seal assembly 77. Groove 84 receives the end of retaining pin 70. A radial opening 86 extends through sleeve member 73 connecting the spaces in which seal assemblies 76 and 79 are positioned.

Interior seals 76 and 77 consist of steel lantern rings 87 and 88 with pressure rings 89 and 90 on opposite ends thereof. The pressure rings 89 and 90 abut against end adapters 91 and 92. Outer seal 79 consists of steel lantern ring 93 with pressure rings 94 and gaskets 95 on opposite ends thereof. Outer seal 80 consists of pressure ring 96 and gasket 97. The interior and outer seals are energized by application of a high-temperature plastic composition through passages 67 as described below.

ASSEMBLY AND OPERATION

In assembling and operating this geothermal wellhead expansion system, a geothermal well bore 11 is drilled to a sufficient depth to permit installation of the surface casing 16. Surface casing 16 is positioned in the upper well bore 11 and cemented in place by the surface cement 18. Next, the casing head or lower spool 20 is secured on the upper end of surface casing 16. Drilling control equipment may then be installed on casing head 20 and the well drilled to the desired depth, i.e. near to the geothermal producing zone.

The production casing string 13 is then run into the well bore 11. The expansion mandrel 21 and annulus seal assembly 61 are installed on the last or landing joint of production casing 13 and lowered through to the casing head 20, where it is suspended and sealed. Next, the cement is introduced through openings 23 and 24 to cement the production casing 13 in place.

After the production casing 13 has been cemented in place, the drilling control equipment may be removed and the remainder of the wellhead expansion system installed. Expansion receiver spool 21 is installed and flanges 34 and 62 bolted together as described above. High temperature plastic, e.g. a high temperature silicone polymer compounded with graphite particles and asbestos fibers, is injected under pressure through flange openings 67 to energize the seals 76, 77, 79 and 80. The plastic, under pressure, compresses the seals and causes them to expand to fill the annular cavity more fully and to maintain a pressurized fit against the wall of the annulus and the smooth exterior surface of the expansion mandrel. Control valves (not shown) are then installed on the receiver spool 21. The well may then be drilled into the geothermal production zone 12.

The production zone 12 will produce high pressure steam or hot water which may reach a temperature of 550° F. or even higher. As the steam or pressurized hot water is produced, the production casing 13 will heat up and expand. On thermal cycling, the temperatures go up and down, and the production casing 13 expands and contracts. The receiver spool 21 and mandrel 51, and all other associated parts, are designed to meet all requirements of all geothermal wells, depending on depth and temperature. The scrapers 59 and 60 are used on the expansion mandrel 51 and annulus seal assembly 61 to remove corrosion, scale and other foreign matter which may build up on the inner wall of the receiver spool 21 while the well is being produced.

DESCRIPTION OF ANOTHER EMBODIMENT

In the embodiment shown in FIGS. 2 and 5, the well and the structure of the geothermal expansion wellhead system is the same as in FIGS. 1 and 4 except for the use of a casing tie back 163 and a slip suspension mandrel 51, and associated structure, as subsequently described. All parts or components which are substantially identical to the corresponding parts or components in FIGS. 1 and 4 are given the same reference numerals as in the first preferred embodiment.

In this embodiment, mandrel 51 is a slip suspension mandrel for protecting production casing 13 during drilling operations. Upper end 150 of mandrel 51 has tapered counterbores 151 and 152 in which there are positioned split slip rings 153. Seal assembly 154 is positioned in the upper mandrel bore above the slip rings 153. A compression ring 155 fits against the end of mandrel 51 and seal assembly 154 and is secured and tightened by bolts 156.

Figure 5:
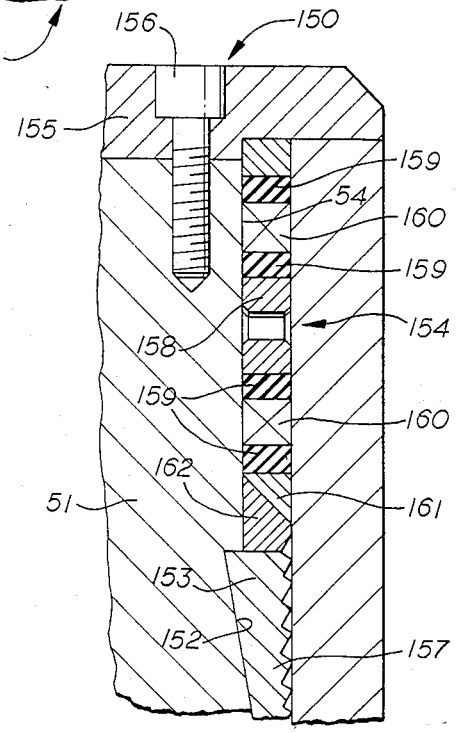
FIG. 5 is a detail sectional view, somewhat enlarged, of the casing seal and slip connection between the expansion mandrel and the production casing, shown at the upper end portion of FIG. 2.

In FIG. 5, the upper end assembly of mandrel 51, slip rings 153 and seal assembly 154 are shown in more detail. Split slip rings 153 have a plurality of spaced, circumferentially-extending, sharp-edged serrations 157 which can grip a casing tightly when compressed. Seal assembly 154 includes lantern ring 158, gasket rings 159, and expansible seals 160. Conical end gasket 161 and conical spacer ring 162 are positioned between the lower end of seal assembly 154 and the upper end of slip ring 153.

ASSEMBLY AND OPERATION

In this embodiment, the sequence of operations is substantially the same as in the embodiment of FIG. 1 except that a slip suspension mandrel is used to protect the production casing during drilling operations. In this embodiment, the surface well bore 11 is drilled to a sufficient depth to permit installation of the surface casing 16. Surface casing 16 is positioned in the upper well bore 11 and cemented in place by the surface cement 18. Next, the casing head or lower spool 20 is secured on the upper end of surface casing 16. Drilling control equipment is then installed on casing head 20 and the well drilled to the desired depth, i.e. near to the geothermal producing zone.

The casing liner is run from the bottom of the well bore and the production casing string 13 is then suspended in the bottom of surface casing 16. The well is then drilled to the geothermal zone 12. The production casing string 13 is then run with liner tie back tool 163. A conventional cementing pack-off tool is then installed on the landing joint and secured on casing head 20. Cement is then introduced to cement from liner hanger 163 to the surface in the annulus between surface casing 16 and production casing 13 and surrounding production casing to the bottom of the hole.

The cement is allowed sufficient time to set up. Then, the drilling equipment is disconnected from the casing head 20 and raised a sufficient distance so that the casing landing joint can be cut into. The cementing tool is then removed from the casing head 20. Next, the slip suspension mandrel 51 and annulus seal assembly 61 are installed on the last or landing joint of production casing 13. Bolts 156 are tightened to compress ring 155 against the upper end of seal assembly 153. The tightening of compression ring 155 causes seals 160 to expand to provide a tight seal between casing 13 and mandrel 51, and also presses slips 157 downward along tapered counterbores 151 and 153 which moves them inward to bite into and grip the casing 13. The seal is then tested.

The remainder of the wellhead expansion system is then installed. Expansion receiver spool 21 is installed and flanges 34 and 62 bolted together as described above. High temperature plastic, e.g. a high temperature silicone polymer compounded with graphite particles and asbestos fibers, is injected under pressure through flange openings 67 to energize the seals 76, 77, 79 and 80. The plastic, under pressure, compresses the seals and causes them to expand to fill the annular cavity more fully and to maintain a pressurized fit against the wall of the annulus and the smooth exterior surface of the expansion mandrel. Control valves (not shown) are then installed on the receiver spool 21.

The well is then ready for production from the geothermal production zone 12. The production zone 12 will produce high pressure steam or hot water which may reach a temperature of 550° F. or even higher. As the steam or pressurized hot water is produced, the production casing 13 will heat up and expand. On thermal cycling, the temperatures go up and down, and the production casing 13 expands and contracts. The receiver spool 21 and mandrel 51, and all other associated parts, are designed to meet all requirements of all geothermal wells, depending on depth and temperature. The scraper 59 on the slip suspension mandrel 51 is operable to remove corrosion, scale and other foreign matter which may build up on the inner wall of the receiver spool 21 while the well is being produced.

DESCRIPTION OF A THIRD EMBODIMENT

Figure 2:
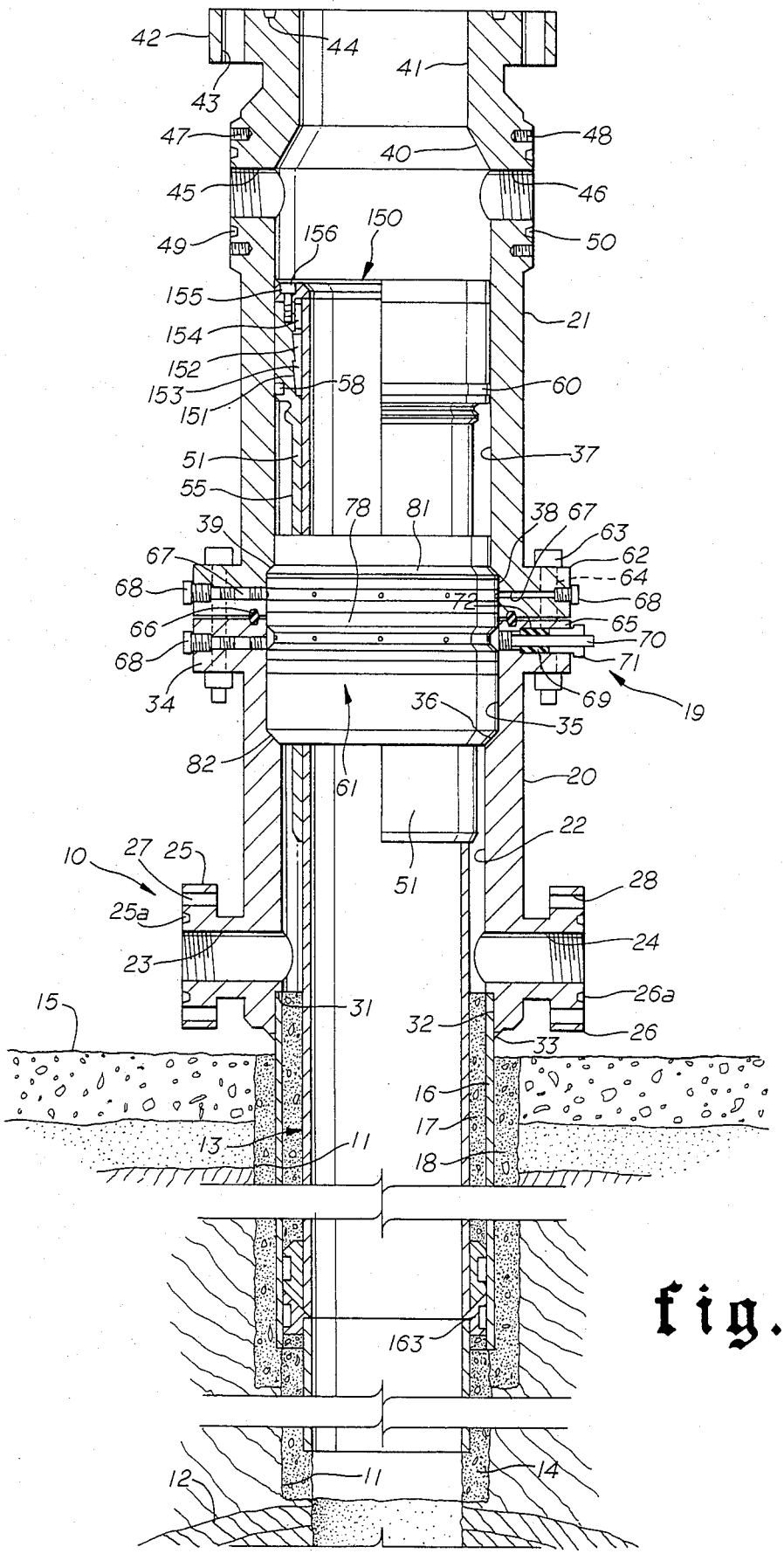
FIG. 2 is a view in vertical central section through another embodiment of the geothermal expansion wellhead system having a slip suspension mandrel for direct connection to the casing the production string during drilling operations.
Figure 3:
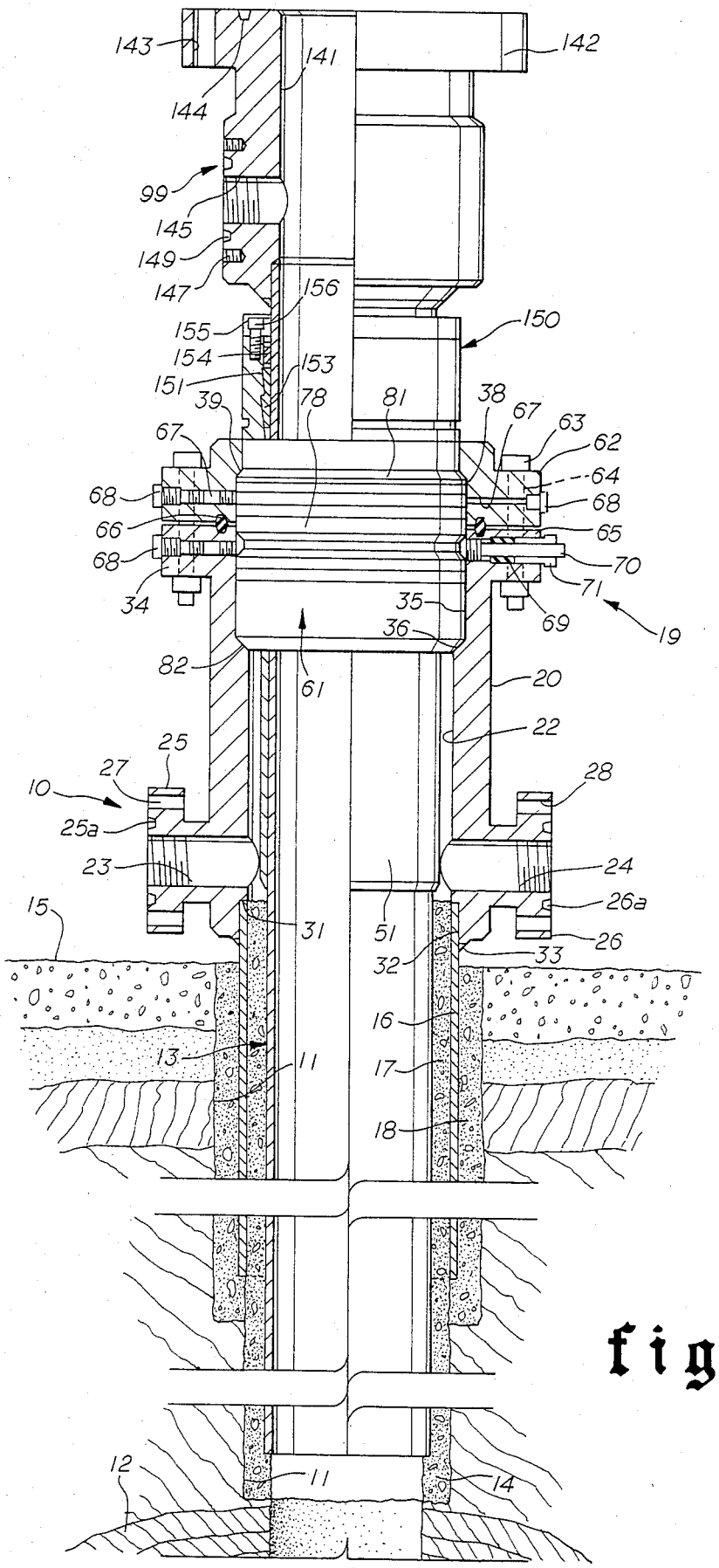
FIG. 3 is a view in vertical central section through a geothermal wellhead system and its connection to the production casing from the geothermal zone producing a dry steam.

In the embodiment shown in FIGS. 3 and 5, the well and the structure of the geothermal expansion wellhead system is the same as in FIGS. 2 and 5 but eliminates the expansion receiver spool 21. In addition, a conventional mud cross 99 is secured directly on the upper end of production casing 13. This embodiment is for completion of geothermal wells producing dry steam at substantially constant temperatures. All parts or components which are substantially identical to the corresponding parts or components in FIGS. 2 and 5 are given the same reference numerals as in the second embodiment.

In this embodiment, mandrel 51 is a slip suspension mandrel connected to production casing 13 in the same manner as in FIGS. 2 and 5. Since the expansion receiver spool 21 is eliminated, it is replaced with a connecting flange assembly 121 which is identical to spool 21 at the flange end thereof. The construction is otherwise the same and like parts have like reference numerals.

Mud cross 99 which is installed on the upper end of production casing 13 has substantially the same construction as the upper end of expansion spool 21 in FIG. 1. Mud cross 99 has a bore 141 surrounded by a flange 142 with holes 143 provided for connection to the flange on a control valve (not shown). A face groove 144 is provided for receiving a gasket for sealing against a like groove in the flange of the control valve. A pair of side openings 145 open laterally from the bore 141. Mud cross 99 has threaded recesses 147 surrounding openings 45 for securing a flanged connector thereto. Peripheral grooves 149 are provided for receiving gaskets to fit against like grooves in the flanges to be connected thereto.

ASSEMBLY AND OPERATION

In this embodiment, the sequence of operations is substantially the same as in the embodiment of FIG. 2 except that the slip suspension mandrel 51 and annulus seal assembly 61 are installed on the last or landing joint of production casing 13 with the end portion of the casing extending therefrom. Bolts 156 are tightened to compress ring 155 against the upper end of seal assembly 153. The tightening of compression ring 155 causes seals 160 to expand to provide a tight seal between casing 13 and mandrel 51, and also presses slips 157 downward along tapered counterbores 151 and 153 which moves them inward to bite into and grip the casing 13. Flange assembly 121 is installed and flanges 34 and 62 bolted together as described above. This secures annulus seal assembly 61, slip suspension mandrel 51 and the end of production casing 13 in a fixed position. High temperature plastic, e.g. a high temperature silicone polymer compounded with graphite particles and asbestos fibers, is injected under pressure through flange openings 67 to energize the seals 76, 77, 79 and 80. The plastic, under pressure, compresses the seals and causes them to expand to fill the annular cavity more fully and to maintain a pressurized fit against the wall of the annulus and the smooth exterior surface of the expansion mandrel. Control valves (not shown) are then installed on the mud cross 99.

The well is then ready for production from the geothermal production zone 12. In this case, production zone 12 produces dry steam. As the steam is produced, the production casing 13 will heat up and expand to a fixed position. The expansion receiver spool 21 is not required in this type of operation. However, if conditions are encountered requiring an expansion joint, the mud cross 99 and flange 121 may be removed and the expansion spool 21 installed to produce the same operating structure as in FIG. 2. If needed, the slip suspension mandrel may be relocated to the end of the production casing as in FIG. 2.

The three systems shown and described herein cover substantially all conditions encountered in geothermal well completion.

While this invention has been described fully and completely with special emphasis on three preferred embodiments, it should be understood that within the scope of the appended claims, this invention may be practiced otherwise than as specifically described and shown herein.

I claim:

1. A geothermal wellhead system comprising a surface casing cemented in the surface portion of a well bore and extending above the earth surface, a production casing cemented in a well bore inside and extending above said surface casing, a casing head having a tubular body portion secured on said surface casing and having an open top end with a surrounding flange having at least one radially extending passageway therein, a hollow member with an opening the same size as said casing head, with a surrounding flange secured to said casing head flange and having at least one radially extending passageway therein, a tubular mandrel secured on said production casing and having a smooth hard cylindrical exterior surface extending through at least part of said casing head and said hollow member, an annular seal assembly positioned adjacent to said flanges in said casing head and said hollow member, said annular seal assembly filling the annular space surrounding said mandrel and having annular pressure activated seals positioned to contact the exterior surface of said mandrel and the interior surface of said casing head and said hollow member, and a high temperature plastic material maintained under pressure against said annular seals and introduced through and filling said radial passageways, the outer ends of said passageways being closed by plug closures.

2. A geothermal wellhead system according to claim 1 in which said mandrel is secured over the top end of said production casing.

3. A geothermal wellhead system according to claim 1 in which said mandrel surrounds and is secured to the exterior surface of said production casing by slip fittings adjacent to the top end of said production casing.

4. A geothermal wellhead system according to claim 1 in which said annular seal assembly comprises an annular sleeve member, said annular sleeve member having annular pressure activated seals on the inside positioned to contact the exterior surface of said mandrel and annular pressure activated seals on the outside positioned to contact the interior surface of said casing head and said hollow member.

5. A geothermal wellhead system according to claim 1 in which said hollow member is a hollow flange member cooperating with said casing head flange to secure said annular seal assembly in position.

6. A geothermal wellhead system according to claim 1 in which said hollow member comprises a hollow tubular spool member having said flange at one end and an open end adapted for connection to a control valve, and said mandrel having an enlarged end portion shaped for sliding movement in said spool member responsive to thermal expansion and contraction of said production casing.

7. A geothermal wellhead system according to claim 6 in which said mandrel enlarged end portion includes at least one scraping ring member engaging the inner wall of said tubular spool member and operable on movement to scrape contaminating material therefrom.

8. A geothermal wellhead system according to claim 1 in which said hollow member comprises a hollow tubular spool member having said flange at one end and an open end adapted for connection to a control valve, said mandrel having an enlarged end portion shaped for sliding movement in said spool member responsive to thermal expansion and contraction of said production casing, and said mandrel enlarged end portion is secured over the top end of said production casing.

9. A geothermal wellhead system according to claim 1 in which said hollow member comprises a hollow tubular spool member having said flange at one end and an open end adapted for connection to a control valve, said mandrel having an enlarged end portion shaped for sliding movement in said spool member responsive to thermal expansion and contraction of said production casing, and said mandrel enlarged end portion surrounds and is secured to the exterior surface of said production casing by slip fittings adjacent to the top end of said production casing.

10. A geothermal wellhead system according to claim 1 in which said hollow member comprises a hollow tubular spool member having said flange at one end and an open end adapted for connection to a control valve, said mandrel having an enlarged end portion shaped for sliding movement in said spool member responsive to thermal expansion and contraction of said production casing, said mandrel enlarged end portion is secured over the top end of said production casing, said annular seal assembly comprises an annular sleeve member, and said annular sleeve member having annular pressure activated seals on the inside positioned to contact the exterior surface of said mandrel and annular pressure activated seals on the outside positioned to contact the interior surface of said casing head and said spool member.

11. A geothermal wellhead system according to claim 1 in which said hollow member comprises a hollow tubular spool member having said flange at one end and an open end adapted for connection to a control valve, said mandrel having an enlarged end portion shaped for sliding movement in said spool member responsive to thermal expansion and contraction of said production casing, said mandrel enlarged end portion surrounds and is secured to the exterior surface of said production casing by slip fittings adjacent to the top end of said production casing, said annular seal assembly comprises an annular sleeve member, and said annular sleeve member having annular pressure activated seals on the inside positioned to contact the exterior surface of said mandrel and annular pressure activated seals on the outside positioned to contact the interior surface of said casing head and said spool member.

12. A geothermal wellhead system according to claim 11 in which said mandrel enlarged end portion surrounds and is secured to the exterior surface of said production casing adjacent to the top end of said production casing, and includes supporting slip rings having circumferentially extending internal serrations providing arcuate sharp edges operable to grip said production casing, an annular seal positioned inside said enlarged end portion around said production casing, and a compression ring secured on the open end of said enlarged end portion and including means to compress said ring against said last named annular seal to compress such seal and to move said slip rings to a position compressively engaging said production casing.

13. A wellhead apparatus for installation in a geothermal wellhead system comprising a surface casing cemented in the surface portion of a well bore and extending above the earth surface, a production casing cemented in a well bore inside and extending above said surface casing, said apparatus comprising a casing head having a tubular body portion adapted to be secured on a surface casing and having an open top end with a surrounding flange having at least one radially extending passageway therein, a hollow member with an opening the same size as said casing head, with a surrounding flange secured to said casing head flange and having at least one radially extending passageway therein, a tubular mandrel adapted to be secured on said production casing and having a smooth hard cylindrical exterior surface extending through at least part of said casing head and said hollow member, an annular seal assembly positioned adjacent to said flanges in said casing head and said hollow member, said annular seal assembly filling the annular space surrounding said mandrel and having annular pressure activated seals positioned to contact the exterior surface of said mandrel and the interior surface of said casing head and said hollow member, and said seal assembly being adapted to be activated by a high temperature plastic material introduced under pressure against said annular seals and through and filling said radial passageways, the outer ends of said passageways being closed by plug closures.

14. A wellhead apparatus according to claim 13 in which said mandrel is secured over the top end of said production casing.

15. A wellhead apparatus according to claim 13 in which said mandrel is adapted to surround and be secured by slip ring fittings therein to the exterior surface of said production casing adjacent to the top end thereof.

16. A wellhead apparatus according to claim 13 in which said annular seal assembly comprises an annular sleeve member, said annular sleeve member having annular pressure activated seals on the inside positioned to contact the exterior surface of said mandrel and annular pressure activated seals on the outside positioned to contact the interior surface of said casing head and said hollow member.

17. A wellhead apparatus according to claim 13 in which said hollow member is a hollow flange member cooperating with said casing head flange to secure said annular seal assembly in position.

18. A wellhead apparatus according to claim 13 in which said hollow member comprises a hollow tubular spool member having said flange at one end and an open end adapted for connection to a control valve, and said mandrel having an enlarged end portion shaped for sliding movement in said spool member responsive to thermal expansion and contraction of said production casing.

19. A wellhead apparatus according to claim 18 in which said mandrel enlarged end portion includes at least one scraping ring member engaging the inner wall of said tubular spool member and operable on movement to scrape contaminating material therefrom.

20. A wellhead apparatus according to claim 13 in which said hollow member comprises a hollow tubular spool member having said flange at one end and an open end adapted for connection to a control valve, said mandrel having an enlarged end portion shaped for sliding movement in said spool member responsive to thermal expansion and contraction of said production casing, and said mandrel enlarged end portion is secured over the top end of said production casing.

21. A wellhead apparatus according to claim 13 in which said hollow member comprises a hollow tubular spool member having said flange at one end and an open end adapted for connection to a control valve, said mandrel having an enlarged end portion shaped for sliding movement in said spool member responsive to thermal expansion and contraction of said production casing, and said mandrel enlarged end portion being adapted to surround and be secured by slip rings therein to the exterior surface of said production casing adjacent to the top end thereof.

22. A wellhead apparatus according to claim 13 in which said hollow member comprises a hollow tubular spool member having said flange at one end and an open end adapted for connection to a control valve, said mandrel having an enlarged end portion shaped for sliding movement in said spool member responsive to thermal expansion and contraction of said production casing, said mandrel enlarged end portion being adapted to be secured over the top end of said production casing, said annular seal assembly comprises an annular sleeve member, and said annular sleeve member having annular pressure activated seals on the inside positioned to contact the exterior surface of said mandrel and annular pressure activated seals on the outside positioned to contact the interior surface of said casing head and said spool member.

23. A wellhead apparatus according to claim 13 in which said hollow member comprises a hollow tubular spool member having said flange at one end and an open end adapted for connection to a control valve, said mandrel having an enlarged end portion shaped for sliding movement in said spool member responsive to thermal expansion and contraction of said production casing, said mandrel enlarged end portion being adapted to surround and be secured by slip fittings therein to the exterior surface of said production casing adjacent to the top end thereof, said annular seal assembly comprises an annular sleeve member, and said annular sleeve member having annular pressure activated seals on the inside positioned to contact the exterior surface of said mandrel and annular pressure activated seals on the outside positioned to contact the interior surface of said casing head and said spool member.

24. A wellhead apparatus according to claim 23 in which said mandrel enlarged end portion is adapted to surround and be secured to the exterior surface of said production casing adjacent to the top end of said production casing, and includes supporting slip rings having circumferentially extending internal serrations providing arcuate sharp edges operable to grip said production casing, an annular seal positioned inside said enlarged end portion for sealing around said production casing, and a compression ring secured on the open end of sad enlarged end portion and including means to compress said ring against said last named annular seal to compress such seal and to move said slip rings to a position compressively engaging said production casing.

25. A method of drilling and completing a geothermal well comprising drilling a surface bore toward a geothermal formation, installing a surface casing and cementing the same in place, installing a casing head having a tubular body portion on said surface casing, said casing head having an open top end with a surrounding flange having at least one radially extending passageway therein, installing drilling control equipment on said casing head, drilling a bore hole through said surface casing for a predetermined depth toward said geothermal formation, setting a production casing in said bore hole, said production casing extending through said casing head, installing a tubular expansion mandrel on the landing joint of said production casing, said mandrel having a smooth hard cylindrical exterior surface extending through and beyond said casing head, installing an annular seal assembly on said mandrel, said annular seal assembly filling the annular space surrounding said mandrel and having annular pressure activated seals positioned to contact the exterior surface of said mandrel and the interior surface of said casing head, lowering said mandrel and seal assembly to said casing head, cementing said production casing, removing the drilling control equipment, installing an expansion receiver spool on said mandrel and securing the same to said casing head, said expansion receiver spool having an opening the same size as said casing head, with a surrounding flange secured to said casing head flange and having at least one radially extending passageway therein, injecting high temperature plastic through said flange passageways to activate said annulus seals, installing a control valve on said expansion receiver spool, and completing the drilling of said well bore into said geothermal production zone.

26. A method of drilling and completing a geothermal well comprising drilling a surface bore toward a geothermal formation, installing a surface casing and cementing the same in place, installing a casing head having a tubular body portion on said surface casing, said casing head having an open top end with a surrounding flange having at least one radially extending passageway therein, installing drilling control equipment on said casing head, drilling a bore hole through said surface casing for a predetermined depth toward said geothermal formation, run a liner from the bottom of said well bore, suspend a production casing in said bore hole, said production casing extending through said casing head, drilling said bore hole to the geothermal production zone, run the production casing with a liner tie back tool, installing a cementing pack-off tool on the landing joint of said production casing and securing the same in said casing head, cementing said surface casing from liner tie back to surface in the annulus of said surface casing, allowing cement sufficient time to set up, disconnecting and raising drilling equipment above said casing head, removing cementing tool from said casing head, cutting off said landing joint, installing a slip suspension mandrel on the upper end of the landing joint of said production casing, said mandrel having a smooth hard cylindrical exterior surface extending through and beyond said casing head, said mandrel having an enlarged end portion shaped for sliding movement in an expansion spool member responsive to thermal expansion and contraction of said production casing, said mandrel enlarged end portion is adapted to surround and be secured to the exterior surface of said production casing adjacent to the top end of said production casing, and includes supporting slip rings having circumferentially extending internal serrations providing arcuate sharp edges operable to grip said production casing, an annular seal positioned inside said enlarged end portion for sealing around said production casing, and installing a compression ring on the open end of said enlarged end portion and tightening securing bolts thereon to compress said ring against said last named annular seal to compress such seal and to move said slip rings to a position compressively engaging said production casing, installing an annular seal assembly on said slip suspension mandrel, said annular seal assembly filling the annular space surrounding said mandrel and having annular pressure activated seals positioned to contact the exterior surface of said mandrel and the interior surface of said casing head, lowering said mandrel and seal assembly to said casing head, installing an expansion receiver spool on said mandrel and securing the same to said casing head, said expansion receiver spool having an opening the same size as said casing head, with a surrounding flange secured to said casing head flange and having at least one radially extending passageway therein, injecting high temperature plastic through said flange passageways to activate said annulus seals, and installing a control valve on said expansion receiver spool.

27. A method of drilling and completing a geothermal well comprising drilling a surface bore between a geothermal formation, installing a surface casing and cementing the same in place, installing a casing head having a tubular body portion on said surface casing, said casing head having an open top end with a surrounding flange having at least one radially extending passageway therein, installing drilling control equipment on said casing head, drilling a bore hole through said surface casing for a predetermined depth toward said geothermal formation, run a liner from the bottom of said well bore, suspend a production casing in said bore hole, said production casing extending through said casing head, drilling said bore hole to the geothermal production zone where dry steam is encountered, run the production casing with a liner tie back tool, installing a cementing pack-off tool on the landing joint of said production casing and securing the same in said casing head, cementing said surface casing from liner tie back to surface in the annulus of said surface casing, allowing cement sufficient time to set up, disconnecting and raising drilling equipment above said casing head, removing cementing tool from said casing head, cutting off said landing joint, installing a slip suspension mandrel just below the upper end of the landing joint of said production casing, said mandrel having a smooth hard cylindrical exterior surface extending through and beyond said casing head, said mandrel having an enlarged end portion shaped for sliding movement in an expansion spool member, if needed, repsonsive to thermal expansion and contraction of said production casing, said mandrel enlarged end portion is adapted to surround and be secured to the exterior surface of said production casing adjacent to the top end of said production casing, and includes supporting slip rings having circumferentially extending internal serrations providing arcuate sharp edges operable to grip said production casing, an annular seal positioned inside said enlarged end portion for sealing around said production casing, and installing a compression ring on the open end of said enlarged end portion and tightening securing bolts thereon to compress said ring against said last named annular seal to compress such seal and to move said slip rings to a position compressively engaging said production casing, installing an annular seal assembly on said slip suspension mandrel, said annular seal assembly filling the annular space surrounding said mandrel and having annular pressure activated seals positioned to contact the exterior surface of said mandrel and the interior surface of said casing head, lowering said mandrel and seal assembly to said casing head, installing a mud cross on the upper end of said production casing above said mandrel, injecting high temperature plastic through said flange passageways to activate said annulus seals, and installing a control valve on said mud cross.

* * * * *